US007551881B2

(12) United States Patent
Iinuma

(10) Patent No.: US 7,551,881 B2
(45) Date of Patent: Jun. 23, 2009

(54) IMAGE FORMING APPARATUS WITH FEATURE FOR DECREASING THE INFLUENCE OF ELECTRIC DISCHARGE IN IMAGE TRANSFER MEMBER

(75) Inventor: Kiyoshi Iinuma, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/956,768

(22) Filed: Dec. 14, 2007

(65) Prior Publication Data

US 2008/0145113 A1 Jun. 19, 2008

(30) Foreign Application Priority Data

Dec. 19, 2006 (JP) ..... 2006-341029

(51) Int. Cl.
*G03G 15/16* (2006.01)

(52) U.S. Cl. ..... 399/302; 399/308

(58) Field of Classification Search ..... 399/302, 399/308, 303, 306

See application file for complete search history.

(56) References Cited

U.S. PATENT DOCUMENTS 5,819,140 A * 10/1998 Iseki et al. ..... 399/165
7,187,890 B2 3/2007 Nishida
7,415,232 B2 * 8/2008 Matsui et al. ..... 399/302
2002/0001489 A1 * 1/2002 Ozaki et al. ..... 399/298
2005/0185991 A1 * 8/2005 Iwakura et al. ..... 399/299
2006/0197825 A1 9/2006 Mohri

FOREIGN PATENT DOCUMENTS

JP 07064403 A * 3/1995
JP 2000-233843 A 8/2000
JP 2004-310064 A 11/2004
JP 2006-276676 A 10/2006

* cited by examiner

*Primary Examiner*—Quana M Grainger
(74) *Attorney, Agent, or Firm*—Fitzpatrick, Cella, Harper & Scinto

(57) ABSTRACT

An image forming apparatus includes a movable belt; a first image carrying member for carrying a toner image; a first transfer member for electrostatically transferring a toner image onto the belt or a recording material carried on the belt; a second image carrying member; and a second transfer member for electrostatically transferring the toner image onto the belt or the recording material carried. The first transfer member contacts the belt and has a first end portion at a first position. The second transfer member contacts the belt and has a second end portion, at a second position, closer to the first end portion than the second contact portion perpendicular to a movement direction of the belt. The first position deviates from the second position so that first and second areas of the belt subjected to electric discharge first do not overlap.

22 Claims, 9 Drawing Sheets

IMAGE FORMING APPARATUS WITH FEATURE FOR DECREASING THE INFLUENCE OF ELECTRIC DISCHARGE IN IMAGE TRANSFER MEMBER

FIELD OF THE INVENTION AND RELATED ART

The present invention relates to an image forming apparatus such as a copying machine, a facsimile machine, or a printer. More specifically, the present invention relates to a so-called tandem-type image forming apparatus using electrophotography or the like.

The recent years, in electrophotographic image forming apparatuses, market demands for high quality, high durability, low cost, full-color image, and the like are increased. Particularly, in these days, with proliferation of a color printer and a color copying machine, full-color machines are frequently used as office equipment. As a result, a demand for an apparatus for outputting full-color images at a speed comparable to monochromatic images is increased.

In order to meet these demands, a so-called tandem-type full-color electrophotographic image forming apparatus has attracted attention (Japanese Laid-Open Patent Application (JP-A) 2006-276676). This apparatus includes a plurality of photosensitive members (image forming stations) arranged in a line and includes a plurality of independent developing apparatuses. On each of the photosensitive members, a single color toner image is formed and the resultant color toner images are successively transferred in a superposition manner to form a composite color image on a recording material.

The tandem-type image forming apparatus is capable of remarkably reducing a printing time (i.e., increasing a printing speed) when compared with a so-called one drum-type image forming apparatus in which an image forming operation using a single (one) photosensitive member is repeated plural times (ordinarily four times) to form a composite full-color image on the photosensitive member.

The tandem-type image forming apparatus is classified into an image forming apparatus using a direct transfer method and an image forming apparatus using an intermediary transfer method.

In the direct transfer method, an image on each of photosensitive members is successively transferred onto a sheet-like member conveyed by a rotatably disposed endless transfer belt (conveying belt) by a transferring apparatus (FIG. 10 of JP-A 2006-276676).

In the intermediary transfer method, an image on each of photosensitive members is once primary-transferred successively onto a rotatably disposed endless intermediary transfer belt by a primary transfer apparatus and thereafter the thus transferred images on the intermediary transfer member are simultaneously transferred onto a recording material by a secondary transfer apparatus (FIGS. 1 and 2 of JP-A 2006-276676).

The intermediary transfer method is capable of setting a secondary transfer position relatively freely and is advantageous for prevention of contamination or the like of the photosensitive members because of non-contact of the recording material with the photosensitive members so that the intermediary transfer method has particularly attracted attention in recent years.

As the transfer apparatus for successively transferring the images formed on the respective photosensitive members onto the recording material in the direct transfer method and as the primary transfer apparatus for successively transferring the images formed on the respective photosensitive members onto the intermediary transfer belt in the intermediary transfer belt, a transfer roller is widely used.

The transfer roller generally includes a core metal formed of SUS, aluminum, or the like and an electroconductive elastic layer formed around the core metal of an electroconductive rubber material or the like in a roller-like shape. The transfer roller is disposed opposite to the plurality of photosensitive members (image forming stations) arranged along a travelling (movement) direction of the transfer belt or the intermediary transfer belt via the belt while contacting the belt. During image formation, a transfer bias of a predetermined polarity and a predetermined potential is applied to each of the respective transfer rollers employed.

At present, as electrophotographic image forming apparatuses for office application, color copying machines and color printers with process speeds of approximately 50 sheets/minute have been placed in the market from various manufacturers. These process speeds are those in the case where A4-size sheets are fed in a direction such that a longitudinal dimension of the sheets is perpendicular to a sheet feeding (conveying) direction of the machines or printers (A4 landscape feeding).

During active moves toward speed-up and low-cost operation, even in the electrophotographic color image forming apparatus, further high speed and service life extension are required for the future. Further, with recent diversification of user needs as a backup, compatibility with various media (recording material, transfer material, etc.) are also required.

The conventional tandem-type image forming apparatus has accompanied with the following problem when subjected to a durability test under a higher speed condition.

The transfer roller is disposed in contact with the transfer belt or the intermediary transfer belt with a certain pressing force. For this reason, as shown in FIG. 11, between the transfer roller and the belt, a contact nip Nc with a predetermined width is formed. During image formation, to the transfer roller, a transfer bias having a predetermined constant voltage or constant current is applied from a power source portion. As a result, electric discharge nips Nd1 and Nd2 are formed at upstream side and downstream side, respectively of the contact nip Nc between the transfer roller and the belt with respect to a belt traveling (movement) direction. FIG. 12 is a schematic view of the contact nip formed between the transfer roller and the belt and the electric discharge nips generated during the transfer bias application to the transfer roller as seen in a longitudinal direction of the transfer roller. Also at both end portions of the transfer roller with respect to the longitudinal direction, electric discharge portions Nd3 are formed.

For example, in a conventional four drum tandem-type full-color image forming apparatus including four photosensitive members (image forming stations) arranged in a line as shown in FIG. 13, all of four (first to fourth) transfer rollers are arranged so as to have equal lengths from their center line positions to their end positions with respect to their width directions. All the transfer rollers used have the same longitudinal dimension of their electroconductive elastic layers. Accordingly, longitudinal end portions of all the four transfer rollers with respect to the belt width direction coincide with each other at longitudinal end portions of the electroconductive elastic layers.

For this reason, the longitudinal end portions of the electroconductive elastic layers of all of the four transfer rollers provides corresponding positional trail lines R and L overlaps with each other the same positions on the belt. As a result, electric discharge currents at the electric discharge nips Nd3 of all of the four transfer rollers are concentrated at local positions of the belt corresponding to the trail line R and L. With respect to the belt traveling direction, a length of the Nd3 is longer than the sum of lengths of Nd1 and Nd2, so that an amount of electric discharge at the longitudinal end portions is larger than that at a central portion.

Due to this concentration of the electric discharge current at the local positions of the belt corresponding to the trail lines R and L, the belt causes a change in electrical resistance and a lowering in strength, thus being prevented from increasing in service life.

SUMMARY OF THE INVENTION

A principal object of the present invention is to provide an image forming apparatus capable of realizing service life extension with a simple constitution.

According to an aspect of the present invention, there is provided an image forming apparatus comprising:

a movable belt member;

a first image carrying member for carrying a toner image;

a first transfer member for electrostatically transferring the toner image carried on the first image carrying member onto the belt member or a recording material carried on the belt member in contact with the first image carrying member;

a second image carrying member for carrying a toner image; and a second transfer member for electrostatically transferring the toner image carried on the second image carrying member onto the belt member or the recording material carried on the belt member in a state in which an area of the belt member having passed through the first image carrying member contacts the second image carrying member, wherein the first transfer member includes a contact portion contacting the belt member and having a first end portion at a first position and the second transfer member includes a contact portion contacting the belt member and having a second end portion, at a second position, closer to the first end portion than the other end portion of the contact portion of the second transfer member with respect to the direction perpendicular to a movement direction of the belt member, wherein with respect to the direction perpendicular to a movement direction of the belt member, the first position is deviated from the second position so that a first area of the belt member subjected to electric discharge from the first end portion does not overlap with a second area of the belt member subjected to electric discharge from the second end portion.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, with reference to the drawings, embodiments of the present invention will be described.

Embodiment 1

Figure 1:
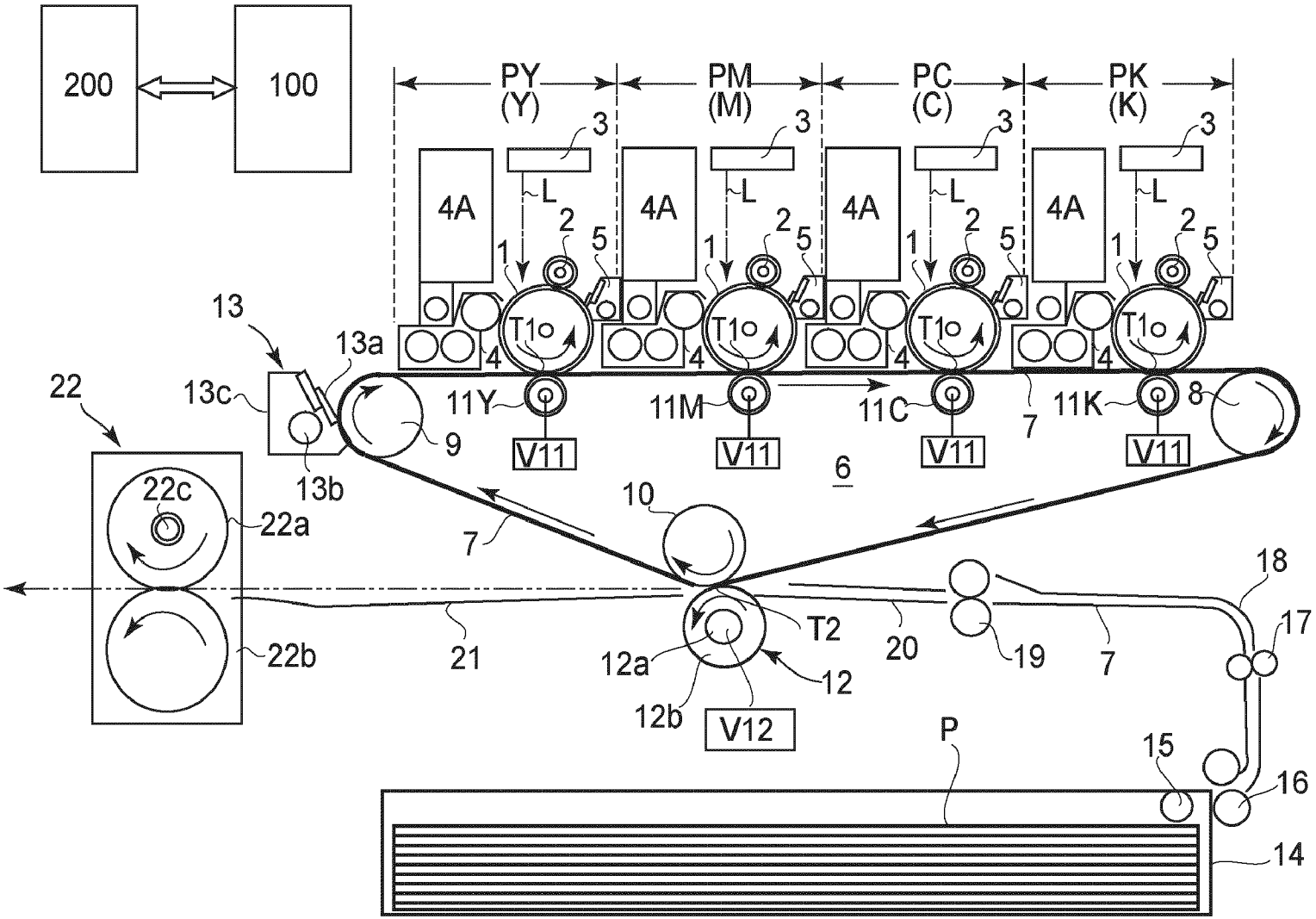
FIG. 1 is a schematic structural view of a major portion of an image forming apparatus in Embodiment 1.
Figure 2:
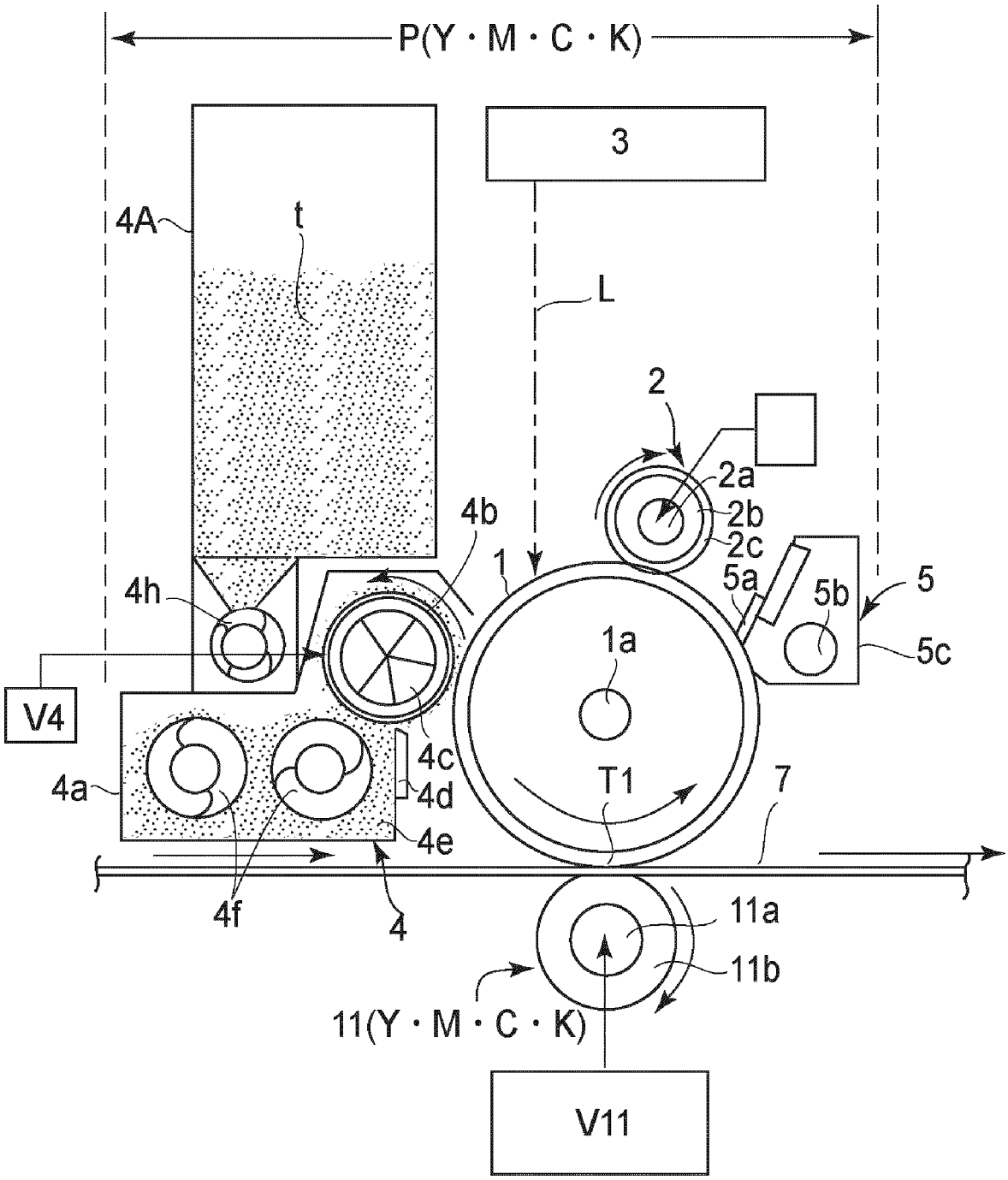
FIG. 2 is an enlarged view of one of image forming stations of the image forming apparatus in Embodiment 1.

FIG. 1 is a schematic structural view of a major portion of an image forming apparatus in this embodiment. This image forming apparatus is four drum tandem-type electrophotographic full-color laser beam printer using an intermediary transfer method. FIG. 2 is an enlarged view of one of the image forming stations of this printer.

(1) General Structure of Printer

This printer includes process units PY, PM, PC and PK as first to fourth image forming stations for forming color toner images of yellow (Y), magenta (M), cyan (C) and black (K), respectively, successively arranged from left to right in FIG. 1.

Each of the process units P (Y, M, C, K) is a laser scanning exposure type electrophotographic process mechanism having the same constitution includes corresponding one of drum-type electrophotographic photosensitive members 1 (hereinafter referred to as a "drum") as first to fourth image carrying members. Further, each process unit includes electrophotographic process means, acting on the drum 1, such as a charging roller 2 as a charging means, a laser scanner 3 as an exposure means, a developing apparatus as a developing means, a drum cleaner 5 as a drum cleaning means, and the like. On the developing apparatus 4, a toner supply chamber 4H is disposed.

Each drum 1 is a cylindrical photosensitive member principally comprising an electroconductive drum base member of aluminum or the like and a negatively chargeable OPC (organic photoconductor) layer formed on an outer peripheral surface of the drum base member. The drum 1 has a supporting shaft 1*a*, as a drum center, rotatably supporting the drum 1 and is rotationally driven at a predetermined speed in a counterclockwise direction of an indicated arrow by a driving means (not shown).

Each charging roller 2 is an electroconductive elastic roller including an electroconductive more metal 2*a*, and a low-resistance electroconductive elastic layer 2*b* and a medium-resistance electroconductive elastic layer 2*c* successively formed around the core metal 2*a* in a roller-shape. This charging roller 2 is disposed substantially in parallel to the drum 1 while being rotatably supported by bearing members at both end portions of the core metal 2*a*. The bearing members are urged against the drum 1 by pressing members against elasticity of the elastic layers of the roller. As a result, the electroconductive elastic layer portion of the charging roller 2 is pressed against the drum 1 with a predetermined pressing force to form a charging nip. The charging roller 2 is rotated by the rotation of the drum 1. To the core metal 2*a* of the charging roller 2, a predetermined charging bias is applied from a charging bias power source V2, so that the rotating surface of the drum 1 is electrically charged uniformly to a predetermined polarity and a predetermined potential. In this embodiment, the drum surface is negatively charged to a predetermined potential.

The laser scanner 3 includes a semiconductor laser, a rotatable polygonal mirror, an fθ lens, a reflecting mirror, and the like. The charged surface of the rotating drum 1 is subjected to main scanning exposure with respect to a drum generatrix direction while laser light from the laser scanner 3 is subjected to ON/OFF modulation on the basis of image information. In this embodiment, this exposure is imagewise exposure. By this exposure, an electrostatic latent image corresponding to the main scanning exposure pattern is formed on the drum surface.

The developing apparatus 4 in this embodiment is a reversal developing apparatus using a two component developer comprising a negatively chargeable toner and a magnetic carrier. The developing apparatus 4 of the first process unit PY accommodates a two component developer comprising an yellow toner and the magnetic carrier and the toner supply chamber 4A of the first process unit PY accommodates the yellow toner. Similarly, the developing apparatuses of the second to fourth process units PM, PC and PK accommodates two component developers comprising a magenta toner and the magnetic carrier, comprising a cyan toner and the magnetic carrier, and comprising a black toner and the magnetic carrier, respectively. Further, the toner supply chambers 4A of the second to fourth process units PM, PC and PK accommodate the yellow toner, the cyan toner and the black toner, respectively.

The developing apparatus 4 includes a developing container 4*a* and a non-magnetic developing sleeve 4*b* as a developer carrying member. The developing sleeve 4*b* is rotatably disposed in the developing container 4*a* while being partly exposed to the outside thereof at its peripheral surface. In the developing sleeve 4*b*, a magnet roller 4*c* is inserted and non-rotationally fixed. A developer regulation blade 4*d* is provided opposite to the developing sleeve 4*b*. In the developing container 4*a*, a two component developer 4*e* is accommodated. At the bottom portion of the developing container 4*a*, developer stirring/conveying members 4*f* are provided. Further, a supply toner t is accommodated in the toner supply chamber 4A.

The two component developer 4*e* principally comprises a mixture of the non-magnetic toner and the magnetic carrier and is conveyed while being stirred by the developer stirring/conveying members 4*f*. The toner is triboelectrically charged to a negative polarity by friction with the magnetic carrier. That is, in this embodiment, the toner is negatively charged triboelectrically to have a polarity identical to the charge polarity of the drum 1.

The developing sleeve 4*b* is disposed close and opposite to the drum 1 while keeping a predetermined closest distance (S-D gap) with the drum 1. The developing sleeve 4*b* is rotationally driven in a direction opposite from the rotational direction of the drum 1 at the opposing portion to the drum 1. By a magnetic force of the magnet roller 4*c* in the developing sleeve 4*b*, a part of the two component developer 4*e* in the developing container 4*a* is adsorbed and held by the outer peripheral surface of the developing sleeve 4*b* as a magnetic brush layer. This magnetic brush layer is rotated and conveyed by the rotation of the developing sleeve 4*b*. The magnetic brush layer is regulated in thickness to form a predetermined thin layer by the developer regulation blade 4*d* and properly rubs the drum surface in contact with the surface of the drum 1 at the opposing portion to the drum 1. To the developing sleeve 4*b*, a predetermined developing bias is applied from a developing bias power source V4.

As a result, the toner in the developer 4*e* conveyed to the developing portion is selectively deposited on the surface of the drum 1 in correspondence with the electrostatic latent image by an electric field of the developing bias. Thus, the electrostatic latent image is developed into a toner image. In this embodiment, the toner is deposited on the surface of the drum 1 at an exposed (light) portion, so that the electrostatic latent image is reversely developed.

The thin developer layer, on the developing sleeve 4*b*, passed through the developing portion is returned into a developer storing portion in the developing container 4*a* by further rotation of the developing sleeve 4*b*.

In order to keep a toner concentration (content) of the two component developer 4*e* in the developing container 4*a* at a substantially constant level, the toner concentration is detected, e.g., an optical toner concentration sensor (not shown). A control circuit portion 100 controls an amount of rotation of a toner supply roller 4*h* of the toner supply chamber 4A depending on detected information to supply the toner from the toner supply chamber 4A to the two component developer 4*e* in the developing container 4*a*. The toner supplied to the two component developer 4*e* is stirred by the developer stirring/conveying members 4*f*.

The drum cleaner 5, as described later, removes a deposited matter such as transfer residual toner remaining on the surface of the drum 1 after the toner image is transferred from the drum 1 onto an intermediary transfer belt member 7 at the primary transfer portion T1. In this embodiment, the drum cleaner 5 includes a drum cleaner blade 5*a* and a conveying screw 5*b*. The blade 5*a* is pressed against the drum 1 at a predetermined angle and predetermined pressure by a pressure means (not shown) and removes the toner and the like remaining on the drum surface. The removed toner and the like are collected in a cleaner container 5*c*. The collected residual toner and the like are conveyed and discharged by the conveying screw.

Below the above-described four process units P (Y, M, C, K), an intermediary transfer unit 6 is disposed. This intermediary transfer unit includes an intermediary transfer belt (belt member) 7 formed of an endless flexible dielectric material as the intermediary transfer member. This belt member 7 is stretched among three rollers consisting of a drive roller 8, a tension roller 9 and a secondary transfer opposite roller 10, which are disposed substantially in parallel with each other, as supporting members. The tension roller 9 is disposed at the first process unit PY side and the drive roller 8 is disposed at the fourth process unit PK side. The secondary transfer opposite roller 10 is disposed at a position below a portion between the tension roller 9 and the drive roller 8. To the belt member 7, a certain tension is applied by the tension roller 9.

The belt member 7 is constituted by a dielectric resin material such as PC, PTC, PVDF, or the like. The belt member 7 is a single layer belt of a thick layer or dielectric material layer of the dielectric resin material or a composite belt including such a layer. In this embodiment, a PI resin material having a volume resistivity of $10^{8.5}$ ohm.cm (as measured by using a probe according to JIS-K6911, applied voltage of 100 V, application time of 60 sec, temperature of 23° C., and humidity of 50% RH) and a thickness t of 100 μm but other material having different volume resistivities and thicknesses may also be employed.

Inside the belt member 7, first to fourth primary transfer rollers 11Y, 11M, 11C and 11K as transfer members for the first to fourth process units (Y, M, C, K), respectively, are disposed.

These primary transfer rollers 11 (Y, M, C, K) are disposed in parallel to each other at an inner side of a belt portion between the drive roller 8 and the tension roller 9 and are pressed against lower surfaces of associated process units, respectively, through the belt member 7. Each of contact portions between the drum 1 and the respective process units P (Y, M, C, K) in a primary transfer nip T1.

Each of the primary transfer rollers 11 (Y, M, C, K) is an electroconductive elastic roller including an electroconductive core metal 11*a* of metal such as SUS or aluminum and a semiconductive elastic layer lib formed on an outer peripheral surface in a roller shape. Each of the primary transfer rollers 11 (Y, M, C, K) is rotatably supported by bearing members at both end portions of the core metal and is arranged in substantially parallel to each other. The bearing members at both end portions of the core metal are urged toward the drum against elasticity of the electroconductive elastic roller portion. As a result, the electroconductive elastic roller portion of the primary transfer roller 11 is pressed against the drum 1 through the belt member 7 with a predetermined pressing force, so that the primary transfer nip T1 is formed between the drum 1 and the belt member 7.

In this embodiment, each of the primary transfer rollers 11 (Y, M, C, K) is constituted by a core metal 11*a* having a diameter of 8 mm and an electroconductive urethane sponge layer lib having a thickness of 4 mm. A hardness of the roller is 30 degrees in terms of Asker C hardness. A resistance value is obtained from a relationship with a current measured by applying a voltage of 500 V to the core metal 11*a* on condition that the roller is rotated at a peripheral speed of 50 mm/sec under a lead of 4.9 N (500 g weight). The resistance value was about $10^5$ ohm, 123° C., 50% RH) In this embodiment, as the electroconductive elastic layer, the urethane sponge layer is used but it is also possible to use other electroconductive elastic materials such as NBR, hydrin rubber, EPDM< and the like. Further, the roller hardness (Asker C) may be 20-40 degrees and the resistance value may be $1\times10^5$–$9\times10^8$ ohm.

Further, to the core metal 11*a*, a predetermined transfer bias (with a predetermined potential and a polarity opposite to the charge polarity of the toner) is applied from a primary transfer bias power source V11.

Outside the belt member 7, a secondary transfer roller 12 is disposed opposite to the secondary transfer opposite roller 10. The secondary transfer roller 12 is prepared by coating another peripheral surface of an electroconductive core metal 12*a* with an EPDM foamed elastic layer 12*b* having a medium resistance. In this embodiment, EPDM is used for the elastic layer 12*b* but other electroconductive elastic materials such as NBR, hydrin rubber, urethane rubber, and the like may also be used. This secondary transfer roller 12 is rotatably supported by bearing members at both end portions of the core metal 12*a* and is disposed in parallel to the secondary transfer opposite roller 10. The bearing members at both end portions of the core metal 12*a* are urged toward the secondary transfer opposite roller 10 against elasticity of the electroconductive elastic roller portion. As a result, the electroconductive elastic roller portion of the secondary transfer roller 12 is pressed against the secondary transfer opposite roller 10 through the belt member 7 with a predetermined pressing force, so that a secondary transfer nip T2 is formed between the belt member 7 and the secondary transfer roller 12. To the core metal 12*a*, a predetermined transfer bias (with a predetermined potential and a polarity opposite to the charge polarity of the toner) is applied from a secondary transfer bias power source V12.

Outside the belt member 7, a belt cleaner 13 for cleaning the outer peripheral surface of the belt member 7 is disposed opposite to the tension roller 9. The belt cleaner 13, as described later, removes a deposited matter such as transfer residual toner and the like remaining on the surface of the belt member 7 after the toner images is transferred from the belt member 7 onto the recording material P at the secondary transfer nip T2. In this embodiment, the belt cleaner 13 includes a belt cleaner blade 13*a* and a conveying screw 13*b*. The blade 13*a* is pressed against the belt member 7 at a predetermined angle and a predetermined pressure by an unshown pressure means to remove the toner and the like. The removed toner and the like is collected in a cleaner container 13*c*. The collected residual toner and the like are conveyed and discharged by the conveying screw 13*b*.

Upstream from the secondary transfer nip T2 with respect to the recording material conveyance direction, a registration roller pair 19 is disposed. Downstream from the secondary transfer nip T2 with respect to the recording material conveyance direction, a recording material guide member 21 and a fixing apparatus are successively disposed.

An operation for forming a full-color image is as follows.

From a host apparatus 200 such as a computer, an image reader, or a facsimile machine, a full-color image information signal is inputted into the control circuit portion (CPU) 100. The control circuit portion 100 manages image forming operation control so that the inputted image information signal is image-processed as desired and the first to fourth process units PY, PM, PC and PK are driven at predetermined control timings of an image forming sequence. As a result, each of the drum 1 is rotationally driven at a predetermined identical speed in a counterclockwise direction of an indicated arrow. Further, the belt member 7 is rotated at a speed identical to the rotation speed of the drum 1 in a clockwise direction of an indicated arrow by the drive roller 8. The surface of the rotating drum 1 is electrically charged uniformly to a predetermined polarity, negative in this embodiment, and a predetermined potential. The charged surface of the drum 1 is subjected to image exposure by the laser scanner 3. The charged surface of the drum 1 is subjected to scanning exposure to laser light which is modulated corresponding to the image-processed image information signal inputted from the control portion 100 and is outputted from the laser scanner 3. As a result, an electrostatic image (electrostatic latent image) corresponding to the scanning exposure pattern is formed on the drum surface. The formed electrostatic image is developed into a toner image by the developing apparatus 4.

As a method of forming the electrostatic image, there is a background exposure method in which the electrostatic image is formed by exposing the charged drum surface to light in correspondence with a background portion of the image information and an image exposure method in which the electrostatic image is formed by exposing the charged drum surface to light in correspondence with the image information portion. In the background exposure method, the electrostatic image is developed by a normal developing method in which a portion other than the background portion is subjected to development. In the image exposure method, a reversal developing method in which a non-exposure portion is subjected to development is employed. In this embodiment, a combination of the image exposure method with the reversal developing method is employed.

By the above-described electrophotographic process, at the first process unit PY, an yellow toner image corresponding to an yellow component image of color-separated component images of a full-color original image is formed on the surface of the drum 1. At the second to fourth process units, PC, PC and PK, a magenta toner image corresponding to a magenta component image, a cyan toner image corresponding to a cyan component image, and a black toner image corresponding to a black component image are formed, respectively, at predetermined control timing.

In the primary transfer nip T1 of the first process unit PY, the yellow toner image formed on the drum 1 is primary-transferred onto the rotationally driven drum member 7. Then, in the primary transfer nip T1 of the second process unit PM, the magenta toner image formed on the drum 1 is primary-transferred onto the yellow toner image on the belt member 7 in a superposition manner. Similarly, in the primary transfer nips T1 of the third and fourth process units PC and PK, the cyan toner image and the black toner image are successively transferred onto the magenta toner image on the belt member 7 in the superposition manner. That is, onto the belt member 7, the four color toner images of yellow, magenta, cyan and black are successively (multi-)transferred in the superposition manner to provide an unfixed full-color toner image.

The primary transfer of the toner image from the drum 1 onto the belt member 7 in each of the primary transfer nips T1 is performed by applying the primary transfer bias from each of the primary transfer bias power sources V11 to each of the primary transfer rollers 11 (Y, M, C, K). As a result, the toner image is electrostatically transferred from the drum 1 onto the belt member 7. In this embodiment, the primary transfer bias has a positive polarity opposite to the negative polarity as the charge polarity of the toner and is a DC voltage with a predetermined potential.

The above formed unfixed toner image (full-color image) on the belt member 7 is conveyed by further rotation of the belt member 7 and reaches the secondary transfer nip T2.

On the other hand, at predetermined control timing, the recording material (recording medium) P in a sheet-feeding cassette 14 is picked up by a pick-up roller 15 and is separated and one by one by a retarding roller 16. The recording material P is conveyed to the registration roller pair 19 through a sheet path 18 including a conveying roller pair 17 and a leading end of the recording material P is received by a nip of the registration roller pair 19 which is stopped at that time. As a result, oblique movement of the recording material P is corrected. The recording material P is fed again by the rotationally driven registration roller pair 19 at predetermined control timing to be conveyed to the secondary transfer nip T2 while being guided by a guide member 20. That is, at timing at which the leading end of the unfixed full-color toner image formed on the belt member 7 reaches the secondary transfer nip T2, start of the rotation of the registration roller pair 19 is controlled so that the leading end coincides with a print start position of the recording material P in the secondary transfer nip T2. During the process of carrying and conveying the recording material P through the secondary transfer nip T2, the secondary transfer bias with the predetermined potential and a polarity opposite to the toner charge polarity is applied from the secondary transfer bias power source V12 to the secondary transfer roller 12. In this embodiment, the secondary transfer bias is a DC voltage with a predetermined potential and a positive polarity opposite to the negative polarity as the toner charge polarity. As a result, the unfixed full-color toner image (component color toner images) on the belt member 7 is simultaneously secondary-transferred onto the recording material P.

The recording material P coming out of the secondary transfer nip T2 is separated from the belt member 7 and introduced into the fixing apparatus 22 by the recording material guide member 21.

In this embodiment, the fixing apparatus 22 is a heat roller fixing apparatus and includes a fixing roller (heating roller) 22*a* rotationally driven in a clockwise direction of an indicated arrow and a pressing roller 22*b* rotated in contact with the fixing roller 22*a*. Inside the fixing roller 22*a*, a heater 22*c* such as a halogen lamp or the like is disposed. By controlling an applied voltage or the like to the heater 22*c*, a surface temperature of the fixing roller 22*a* is kept at a predetermined fixing temperature. The recording material P is guided in a fixing nip as a contact portion between the roller pair 22*a* and 22*b* and is nipped and conveyed in the fixing nip under application of heat and pressure. As a result, the toners of the respective component color toner images on the recording material P are melted and mixed to be fixed on the recording material surface as a full-color image (fixed image) and then is discharged outside the image forming apparatus as a full-color print.

The surface of the belt member 7 after the separation of the recording material is cleaned by the removal of the secondary transfer residual toner by means of the belt cleaner 13 during a subsequent rotation process of the belt member 7, thus preparing for a next image forming operation.

(2) Arrangement of First to Fourth Primary Transfer Rollers 11 (Y, M, C, K)

Figure 3:
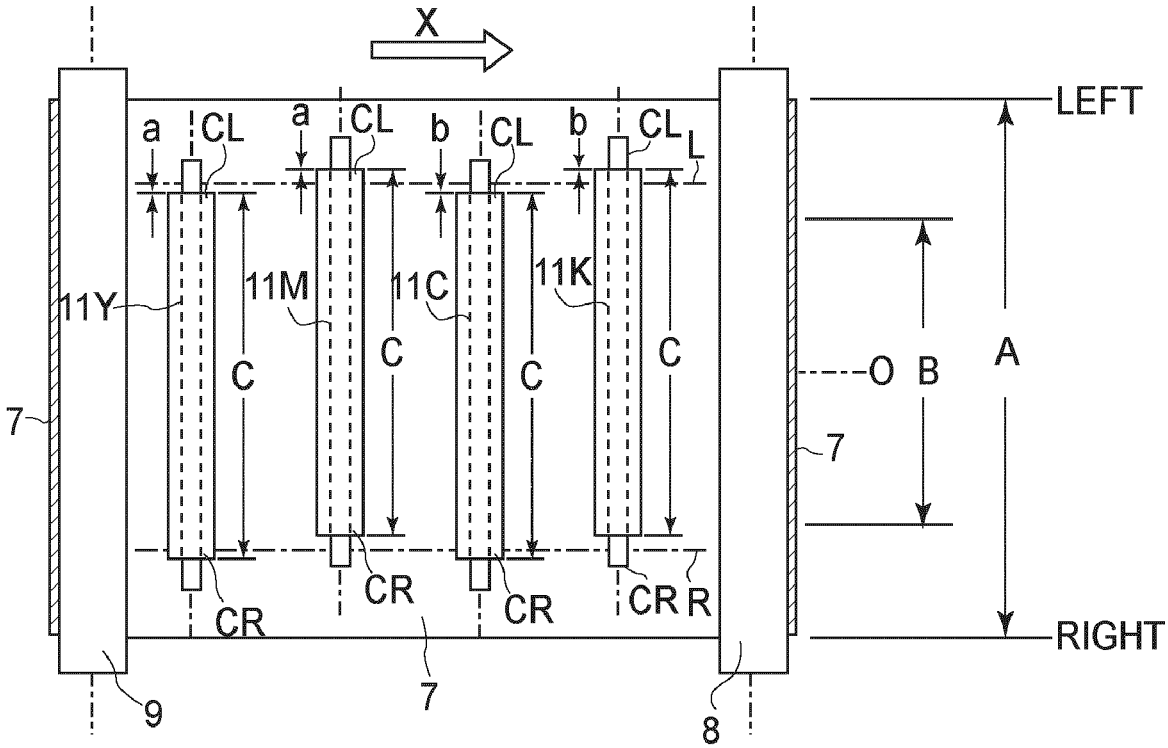
FIG. 3 is a schematic view for illustrating an arrangement of a plurality of (first to fourth) primary transfer rollers.
Figure 4:
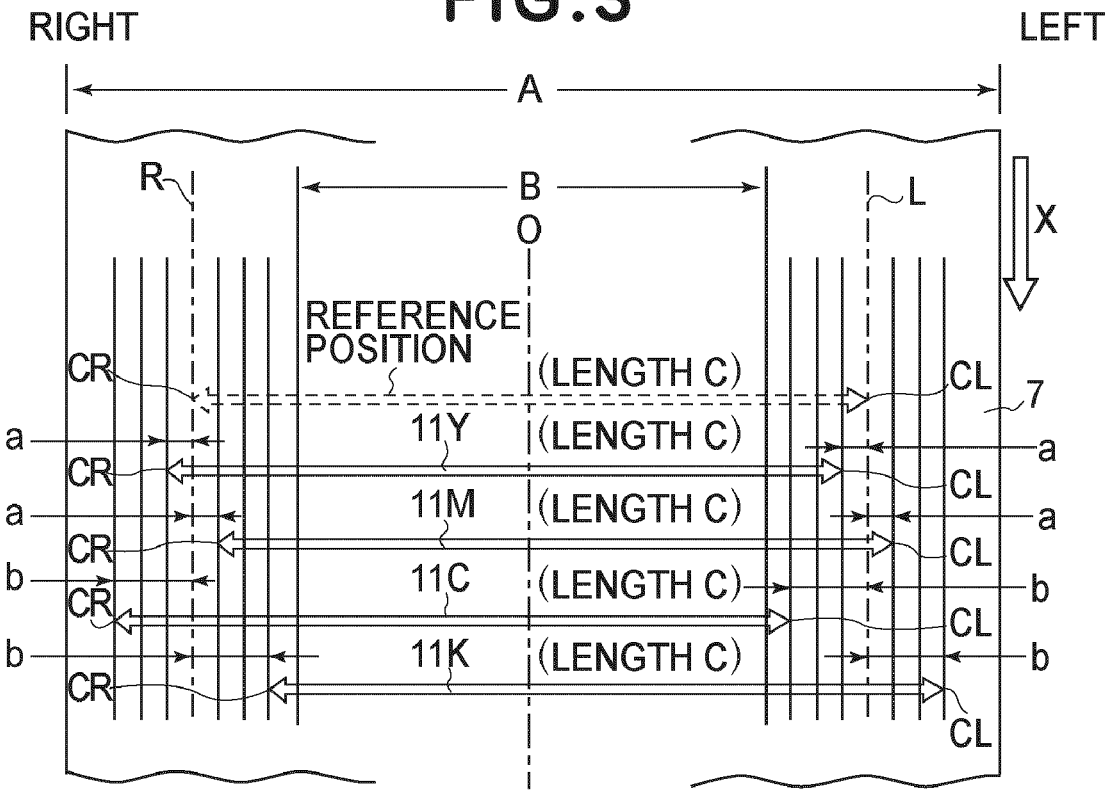
FIG. 4 is another schematic view for illustrating the arrangement of the primary transfer rollers.

FIGS. 3 and 4 are schematic views for illustrating an arrangement of the first to fourth primary transfer rollers 11 (Y, M, C, K) in this embodiment (Embodiment 1).

Here, with respect to the primary transfer rollers 11 (Y, M, C, K), a "longitudinal" or "longitudinal direction" means as axial direction of the roller 11, and a "longitudinal dimension" means a dimension with respect to the longitudinal direction at a portion (electroconductive elastic layer) of the roller 11 contacting the belt member 7. Further, the "longitudinal (direction) end portion" means an end portion of the portion (electroconductive elastic layer) of the roller 11 contacting the belt member 7 with respect to the longitudinal direction.

Further, with respect to the belt member 7 or an area, a "width" means a direction perpendicular to a belt traveling (movement) direction X at the belt surface or a dimension with respect to the direction (perpendicular to the belt traveling direction X.

In FIGS. 3 and 4, a width dimension of the belt member 7 is represented by A and a width center line (phantom line) of the belt member 7 is represented by O. A maximum width dimension of an image area to be formed on the belt surface is represented by B. In this embodiment, on the basis of the belt width center line O (center line basis), an image is formed on the belt surface in such a manner that an entire image area is equally divided into two areas (left and right areas) with respect to the width center line O. Further, the belt width dimension A is larger than the image area maximum width dimension B.

The first to fourth primary transfer rollers 11 (Y, M, C, K) are successively disposed from an upstream side to a downstream side with respect to the belt traveling direction at the back (rear) surface of the belt member 7 with their longitudinal directions perpendicular to the belt traveling direction. For each of the primary transfer rollers 11 (Y, M, C, K) is, as described above, the both end portions of the core metal and rotatably supported by the bearing members and the bearing members are urged toward the drum 1 against the elasticity of the roller elastic layer by the pressing members. As a result, the electroconductive elastic roller portion of the primary transfer roller 11 is pressed against the drum 1 through the belt member 7 with the predetermined pressing force to form the primary transfer nip T1 between the drum 1 and the belt member 7.

A longitudinal dimension of the primary transfer roller 11 (electroconductive elastic layer) is represented by C ("LENGTH C"). In this embodiment, the first to fourth primary transfer rollers 11 (Y, M C, K) have the substantially equal longitudinal dimension C. Herein, the term "substantially equal" means that a difference in longitudinal dimension between the primary transfer rollers is within 0.5 mm in view of manufacturing variation.

The longitudinal dimension C of the primary transfer roller 11 is larger than the maximum width dimension B of the image area and is smaller than the width dimension A of the belt member 7. The both end portions (edges) of the primary transfer roller 11 with respect to the longitudinal direction are represented by CR (right end) and a CL (left end).

Corresponding positional trail lens (phantom lines) on the belt member 7 with respect to the right end CR and the left end CL when the belt member 7 is rotationally moved with a longitudinally equal arrangement of the primary transfer rollers 11 having the longitudinal dimension C on the basis of the belt width center line O (center line basis) are represented by R and L, respectively. This arrangement of the primary transfer rollers 11 is referred to as a reference arrangement. Further, R is referred to as a right end reference line and L is referred to as a left end reference line.

In this embodiment, the first primary transfer roller 11Y is disposed and shifted by a (mm) toward the right side of belt width direction with respect to the reference arrangement. Accordingly, the right end CR of the roller 11Y is located corresponding to the belt surface at a position outside the right end reference line R by a (mm) and the left end CL is located corresponding to the belt surface at a position inside the left end reference line L by a (mm).

The second primary transfer roller 11M is disposed and shifted by a (mm) toward the left side of the belt width direction with respect to the reference arrangement. Accordingly, the right end CR of the roller 11M is located corresponding to the belt surface at a position inside the right end reference line R by a (mm) and the left end CL is located corresponding to the belt surface at a position outside the left end reference line L by a (mm).

The second primary transfer roller 11C is disposed and shifted by b (>a) (mm) toward the right side of the belt width direction with respect to the reference arrangement. Accordingly, the right end CR of the roller C is located corresponding to the belt surface at a position outside the right end reference line R by b (mm) and the left end CL is located corresponding to the belt surface at a position inside the left end reference line L by b (mm).

The second primary transfer roller 11K is disposed and shifted by b (mm) toward the left side of the belt width direction with respect to the reference arrangement. Accordingly, the right end CR of the roller K is located corresponding to the belt surface at a position inside the right end reference line R by b (mm) and the left end CL is located corresponding to the belt surface at a position outside the left end reference line L by b (mm).

Even when the first to fourth primary transfer rollers 11 (Y, M, C, K) are shifted toward the right side of or the left side of the belt width direction with respect to the reference arrangement as described above, any of the rollers is constituted so that the electroconductive elastic roller portion can sufficiently cover the maximum width dimension B.

The shift amounts a (mm) and b (mm) of the primary transfer rollers 11 (Y, M, C, K) in the belt width direction arrangement were determined on the basis of the following experiment.

Figure 14:
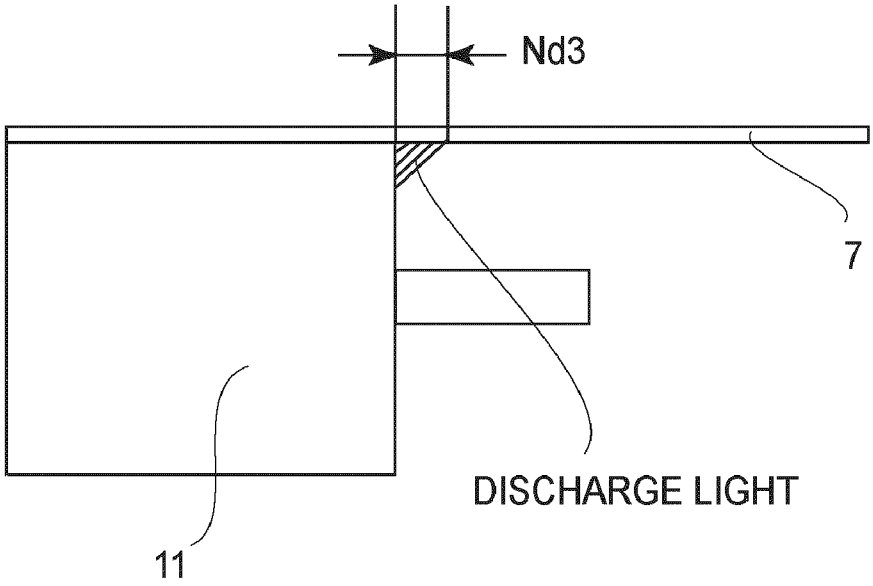
FIG. 14 is a schematic view for illustrating a measuring method of a relationship between a transfer contrast and an electric discharge nip Nd3 of a primary transfer roller.

In the image forming apparatus having the above-described constitution in this embodiment, a high-sensitivity small-size camera capable of visualizing an end portion of the primary transfer roller 11 and the neighborhood thereof shown in FIG. 14 was provided and electric discharge light generated between the primary transfer roller 11 and the intermediary transfer belt member 7 when a voltage was applied to the primary transfer roller 11 was observed. The drum surface potential was fixed to a level of an ordinary image forming condition and a relationship between an electrical discharge nip width Nd3 and a potential difference (transfer contrast) between the primary transfer roller and the drum when an applied voltage condition to the primary transfer roller was changed was studied. The relationship is shown in Table 1.

TABLE 1

| | Contrast (kV) | | | | | | |
|---|---|---|---|---|---|---|---|
| | 1 | 2 | 3 | 4 | 5 | 6 | 7 |
| Nd3 (mm) | 0.04 | 0.13 | 0.3 | 0.52 | 0.81 | 1.14 | 1.5 |

The nip width Nd3 at the transfer contrast of 7 (kV) was 1.5 (mm). An ordinarily employed transfer contrast is in the range of approximately 0.4 (kV) to 6.0 (kV) but in view of some latitude, it is necessary to provide a minimum shift amount of 1.5 mm so that areas having the nip widths Nd3 of the primary transfer rollers 11 (Y, M, C, K) do not overlap with each other.

From the above result, the value a may preferably be set to 1.5 (mm) or more. For example, the value a may be set in the range of 1.5-3.0 (mm). The value may preferably be set to 3.0 (mm) or more. For example, the value b may be set in the range of 3.0-6.0 (mm). However, b (mm)>a (mm) is required. Further, a higher effect can be achieved when the value a is 2.5 (mm) and the value b is 5.0 (mm).

In this embodiment, as described above, with respect to a direction perpendicular to the movement (travelling) direction of the belt member 7, the positions of the end portions of the belt member contact portions of the primary transfer rollers 11 (Y, M, C, K) are different from each other so that areas of the belt member 7 subjected to electric discharge from corresponding end portions of the primary transfer rollers do not overlap with each other. As a result, it is possible to stably output a good image for a long term.

Embodiment 2

Figure 5:
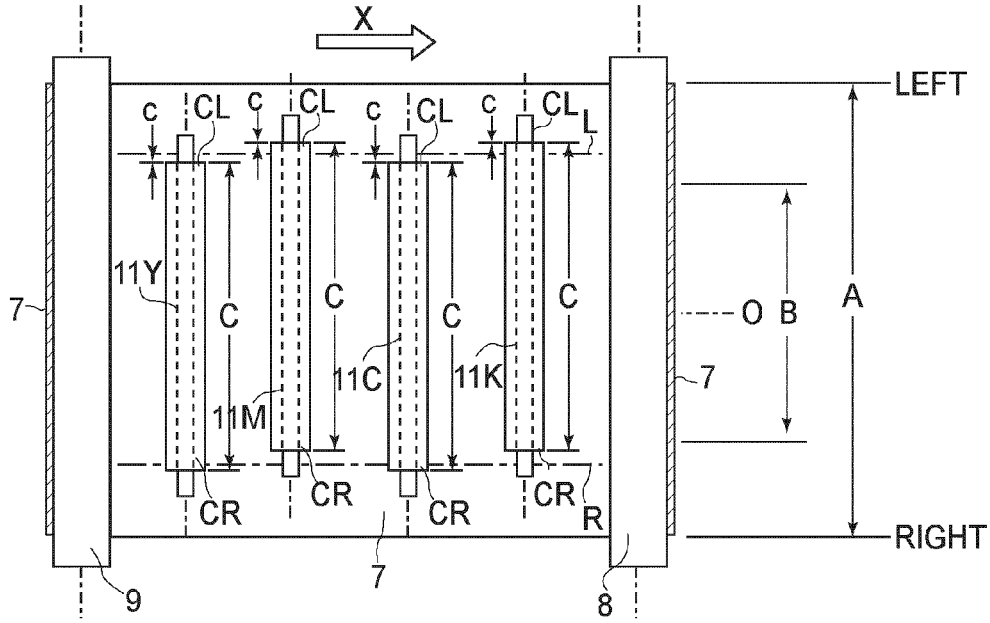
FIGS. 5 to 9 are schematic views for illustrating arrangements of pluralities of primary transfer rollers in Embodiment 2, Embodiment 2, Embodiment 3, Embodiment 3, and Embodiment 4, respectively.
Figure 6:
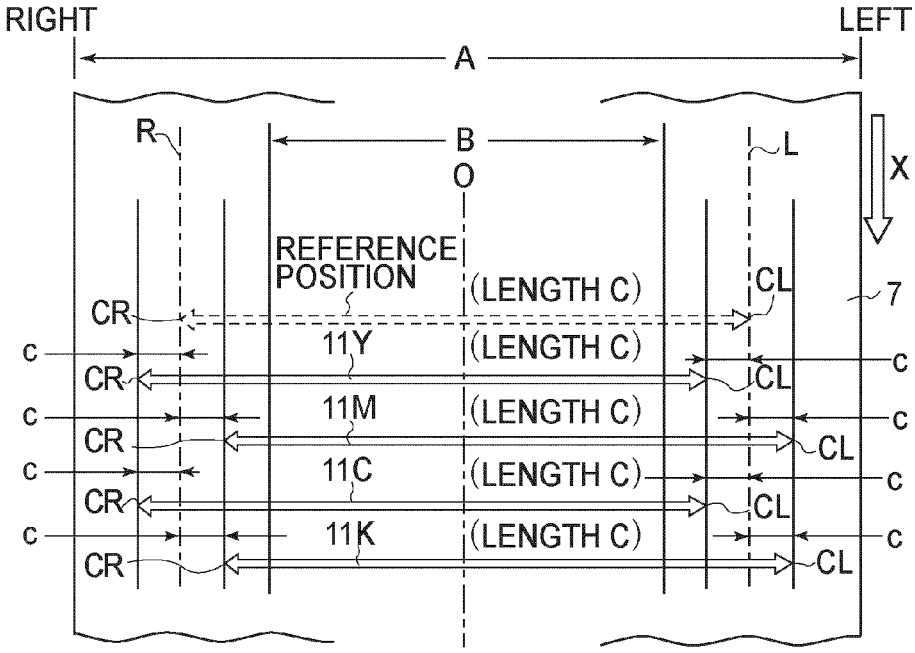

FIGS. 5 and 6 are schematic view for illustrating an arrangement of the first to fourth primary transfer rollers 11 (Y, M, C, K) in this embodiment (Embodiment 2).

In this embodiment, the first and third primary transfer rollers 11Y and 11C are disposed and shifted by c (mm) toward the right side of belt width direction with respect to the reference arrangement. Accordingly, the right ends CR of the rollers 11Y and 11C are located corresponding to the belt surface at positions outside the right end reference line R by c (mm) and the left ends CL are located corresponding to the belt surface at positions inside the left end reference line L by c (mm).

The second and fourth primary transfer rollers 11M and 11K are disposed and shifted by c (mm) toward the left side of the belt width direction with respect to the reference arrangement. Accordingly, the right end CR of the rollers 11M and 11K are located corresponding to the belt surface at positions inside the right end reference line R by c (mm) and the left end CL is located corresponding to the belt surface at positions outside the left end reference line L by c (mm).

In this embodiment, the value c may preferably be set to 1.5 (mm) or more. For example, the value c may be set in the range of 1.5-3.0 (mm).

Even when the first to fourth primary transfer rollers 11 (Y, M, C, K) are shifted toward the right side of or the left side of the belt width direction with respect to the reference arrangement as described above, any of the rollers is constituted so that the electroconductive elastic roller portion can sufficiently cover the maximum width dimension B.

In this embodiment, with respect to the first and third primary transfer rollers 11Y and 11C of the first to fourth primary transfer rollers 11 (Y, M, C, K), corresponding positional trail lines on the belt member 7 for the right ends CR and the left ends CL overlap with each other at the same positions, respectively. Further, with respect to the second and fourth primary transfer rollers 11M and 11K, corresponding positional trail lines on the belt member 7 for the right ends CR and the left ends CL overlap with each other at the same positions, respectively. However, between the first and second primary transfer rollers 11Y and 11M and between the third and fourth primary transfer rollers 11C and 11K, the positions of the end portions of the belt member contact portions of the two primary transfer rollers are different from each other so that areas of the belt member 7 subjected to electric discharge from corresponding end portions of the primary transfer rollers do not overlap with each other.

Figure 13:
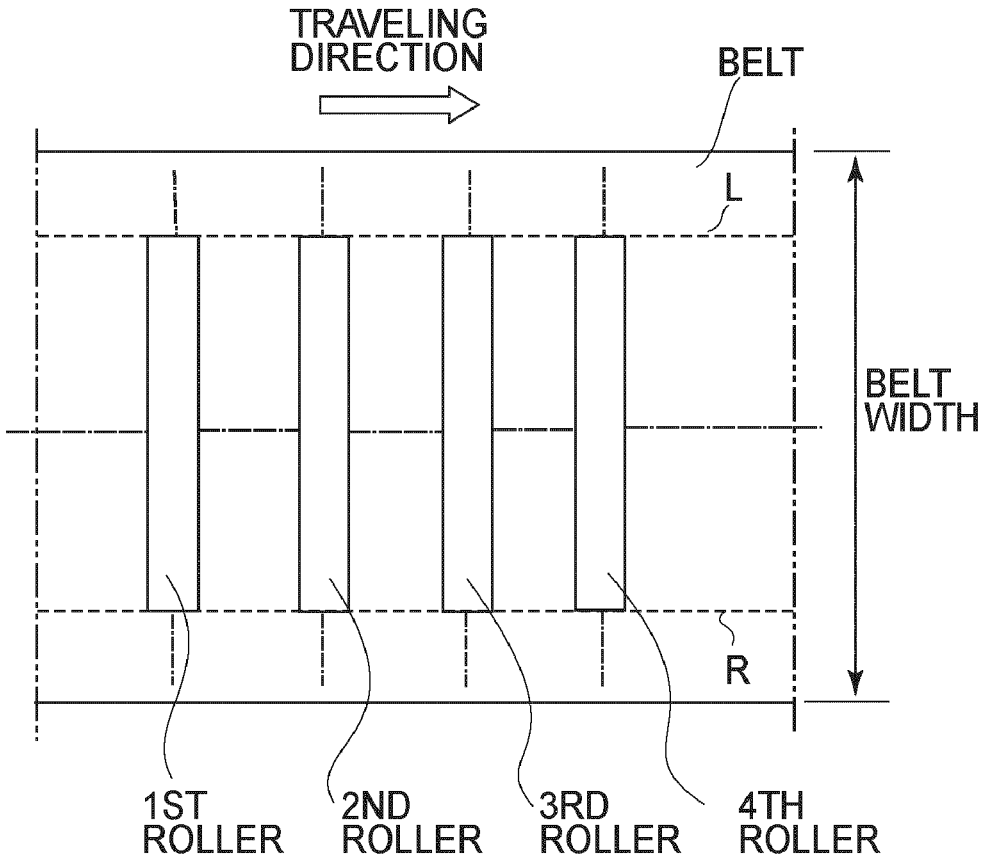
FIG. 13 is a schematic view for illustrating an arrangement of a plurality of transfer rollers in a conventional image forming apparatus.

Accordingly, different from the arrangement shown in FIG.13 in which the corresponding positional trail lines R and L on the belt member 7 for all the four (first to fourth) primary transfer rollers at the longitudinal end portions of the primary transfer rollers overlap with each other at the same positions, the corresponding positional trail lines in this embodiment do not overlap with each other at the same positions. Therefore, it is possible to suppress a lowering in belt lifetime due to concentration of electric discharge current at limited portions along these trail lines. As a result, it is possible to stably output a good image for a long term.

Embodiment 3

Figure 7:
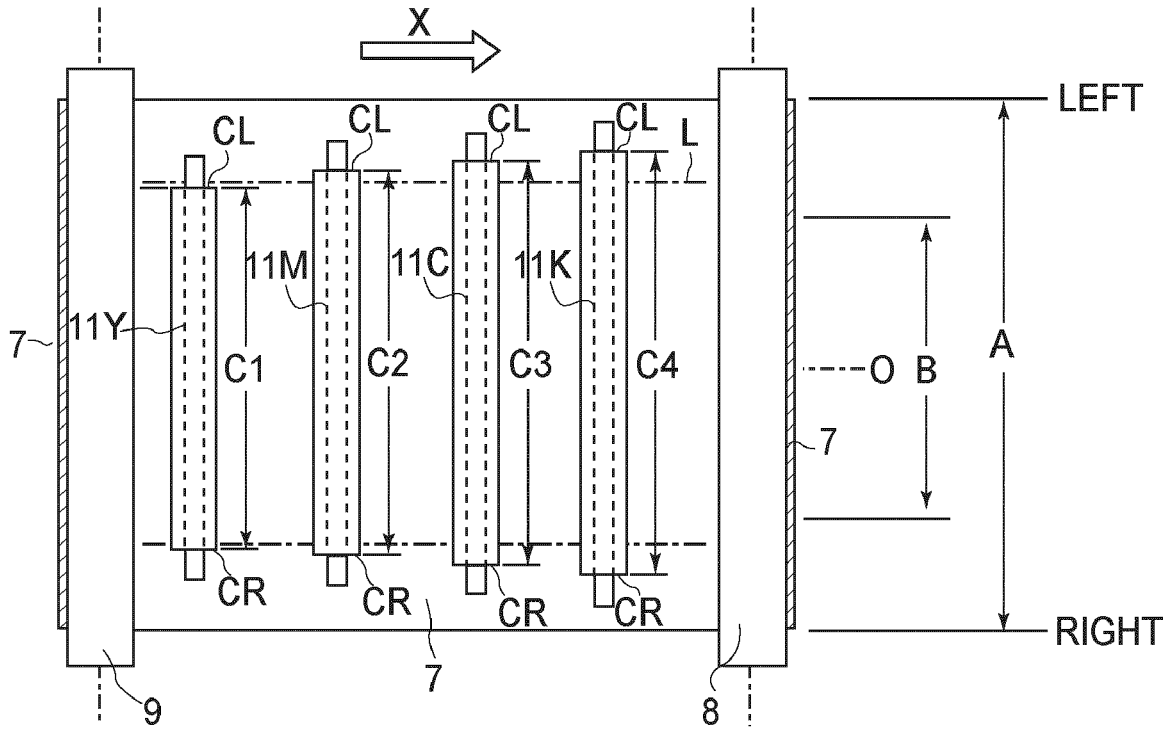
Figure 8:
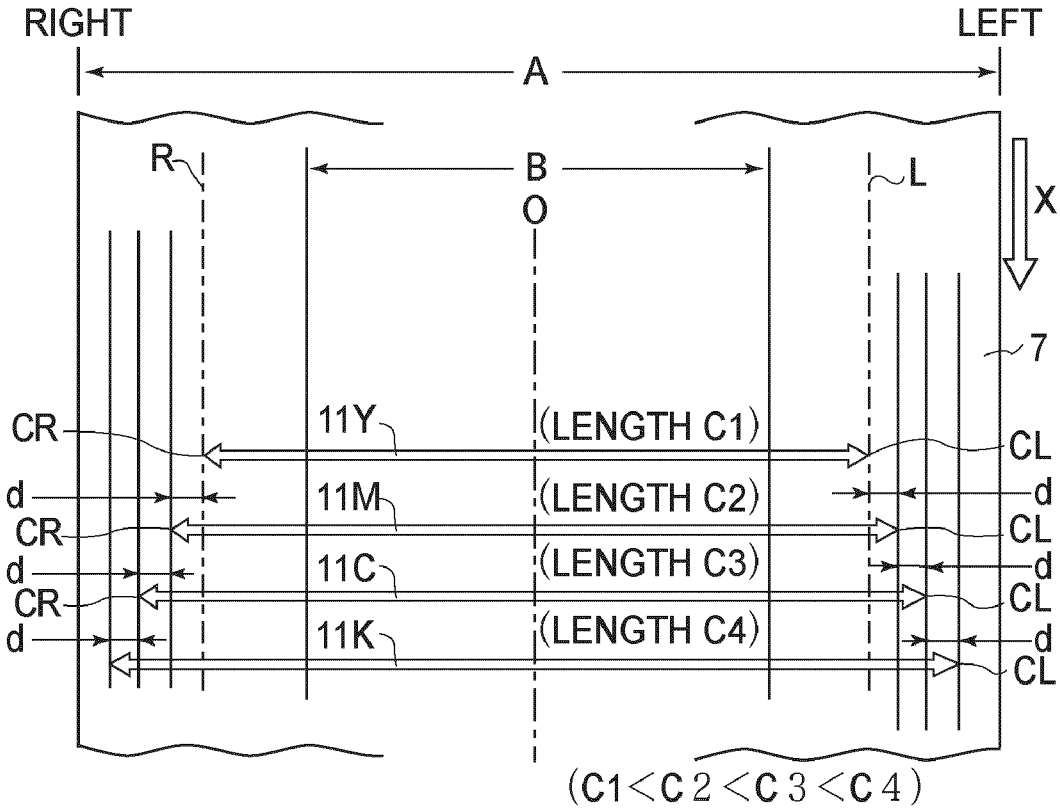

FIGS. 7 and 8 are schematic view for illustrating an arrangement of the first to fourth primary transfer rollers 11 (Y, M, C, K) in this embodiment (Embodiment 3).

In this embodiment, longitudinal dimensions C1, C2, C3 and C4 of the first to fourth primary transfer rollers 11 (Y, M, C, K) are different from each other, so that corresponding positions on the belt member 7 for the right ends CR and left ends CL of the four rollers are also different from each other. More specifically, in this embodiment, the longitudinal dimensions of the first to fourth primary transfer rollers 11 (Y, M, C, K) are set to satisfy C1<C2<C3<C4 and the first to fourth primary transfer rollers 11 (Y, M, C, K) are disposed on the center line basis with respect to the belt width center line (in a center line symmetry manner). As a result, the corresponding positions on the belt member 7 for the right ends CR and left ends CL of the respective rollers with respect to the belt width direction are different from each other. Even the first primary transfer roller 11Y having the smallest longitudinal dimension is constituted so that the electroconductive elastic roller portion can sufficiently cover the maximum dimension B of the image area.

In this embodiment, a value d represents an amount of positional deviation between adjacent two rollers with respect to the belt width direction. The value d may preferably be set to 1.5 (mm) or more. For example, the value d may be set in the range of 1.5-3.0 (mm).

By arranging the first to fourth primary transfer rollers 11 (Y, M, C, K) as described above, corresponding positions on the belt member 7 for the right ends CR and left ends CL of the respective rollers with respect to the belt width direction are different from each other. That is, with respect to the direction perpendicular to the movement direction of the belt member 7, the positions of the end portions of the belt member contact portions of the two primary transfer rollers 11 (Y, M, C, K) are different from each other so that areas of the belt member 7 subjected to electric discharge from corresponding end portions of the primary transfer rollers do not overlap with each other.

Accordingly, different from the arrangement shown in FIG. 13 in which the corresponding positional trail lines R and L on the belt member 7 for all the four (first to fourth) primary transfer rollers at the longitudinal end portions of the primary transfer rollers overlap with each other at the same positions, the corresponding positional trail lines in this embodiment do not overlap with each other at the same positions. Therefore, it is possible to suppress a lowering in belt lifetime due to concentration of electric discharge current or mechanical stress at limited portions along these trail lines. As a result, it is possible to stably output a good image for a long term.

With respect to the image forming apparatuses in Embodiments 1 to 3, a comparative experiment with an image forming apparatus of Comparative Embodiment 1 was performed in the following manner.

In the image forming apparatus of Comparative Embodiment 1, first to fourth (four) primary transfer rollers 11 (Y, M, C, K) having the same longitudinal dimension are arranged on the center line basis (in the center line symmetry manner) as shown in FIG. 13.

In this comparative experiment, a state of deterioration of each of the intermediary transfer belt members 7 was observed as a durability performance of the belt member 7 when a continuous printing operation was performed at a process speed (PS) of 300 mm/sec and a print speed of 80 sheets/min.

As a result, the durability performances of the belt members 7 in Embodiments 1 to 3 were better than the durability performance of the belt member 7 in Comparative Embodiment 1. More specifically, the order of the durability performance in [Embodiment 1]≈[Embodiment 3]>[Embodiment 2]>[Comparative Embodiment 1].

This may be attributable to a change (alleviation) in electric discharge current flowing into the limited portions of the belt member depending on a degree of overlapping among the corresponding positions on the belt member for the longitudinal end portions of the primary transfer rollers 11 (Y, M, C, K).

Embodiment 4

Figure 9:
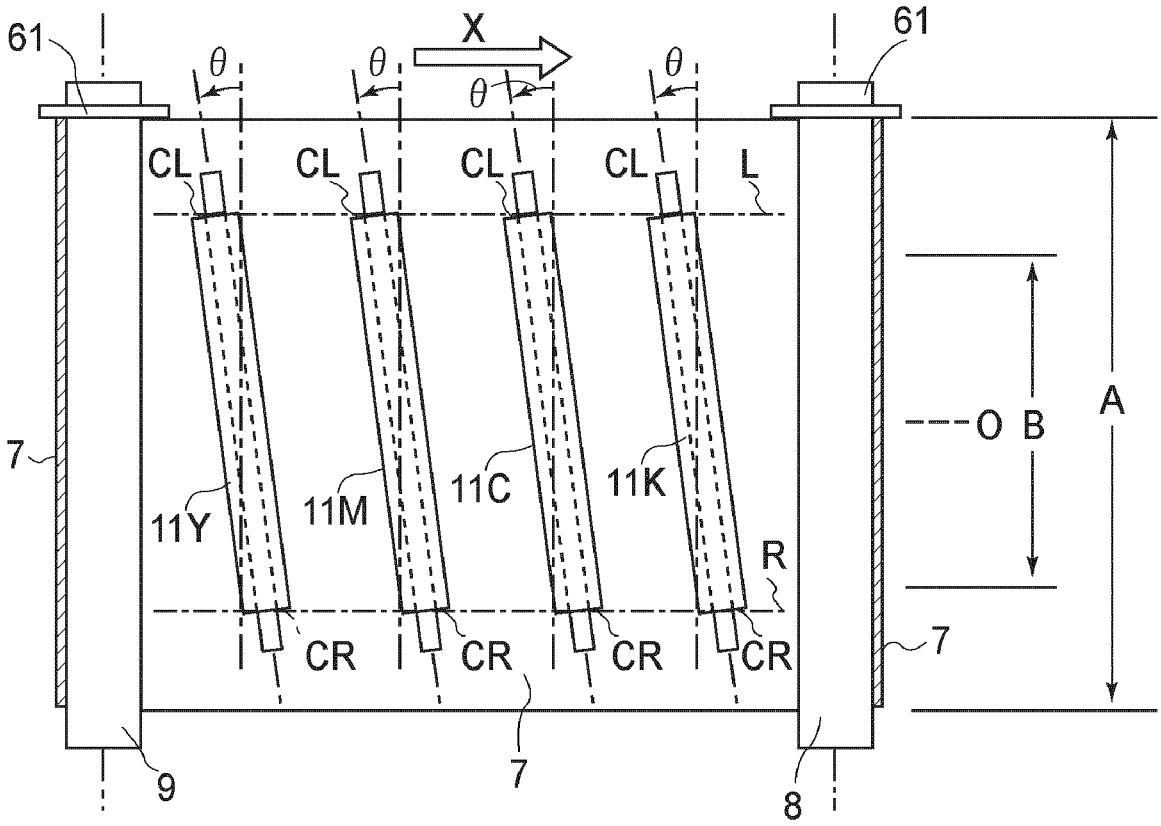

In this embodiment, the first to fourth primary transfer rollers 11 (Y, M, C, K) in each of the image forming apparatuses in Embodiments 1 to 3 are arranged as shown in FIG. 9 so that they have an appropriate inclination angle θ (e.g., about 2 degrees) with respect to the width direction of the belt member 7. In this embodiment, the image forming apparatuses can achieve the same effect as those achieved by the image forming apparatuses in Embodiments 1 to 3.

Embodiment 5

Figure 10:
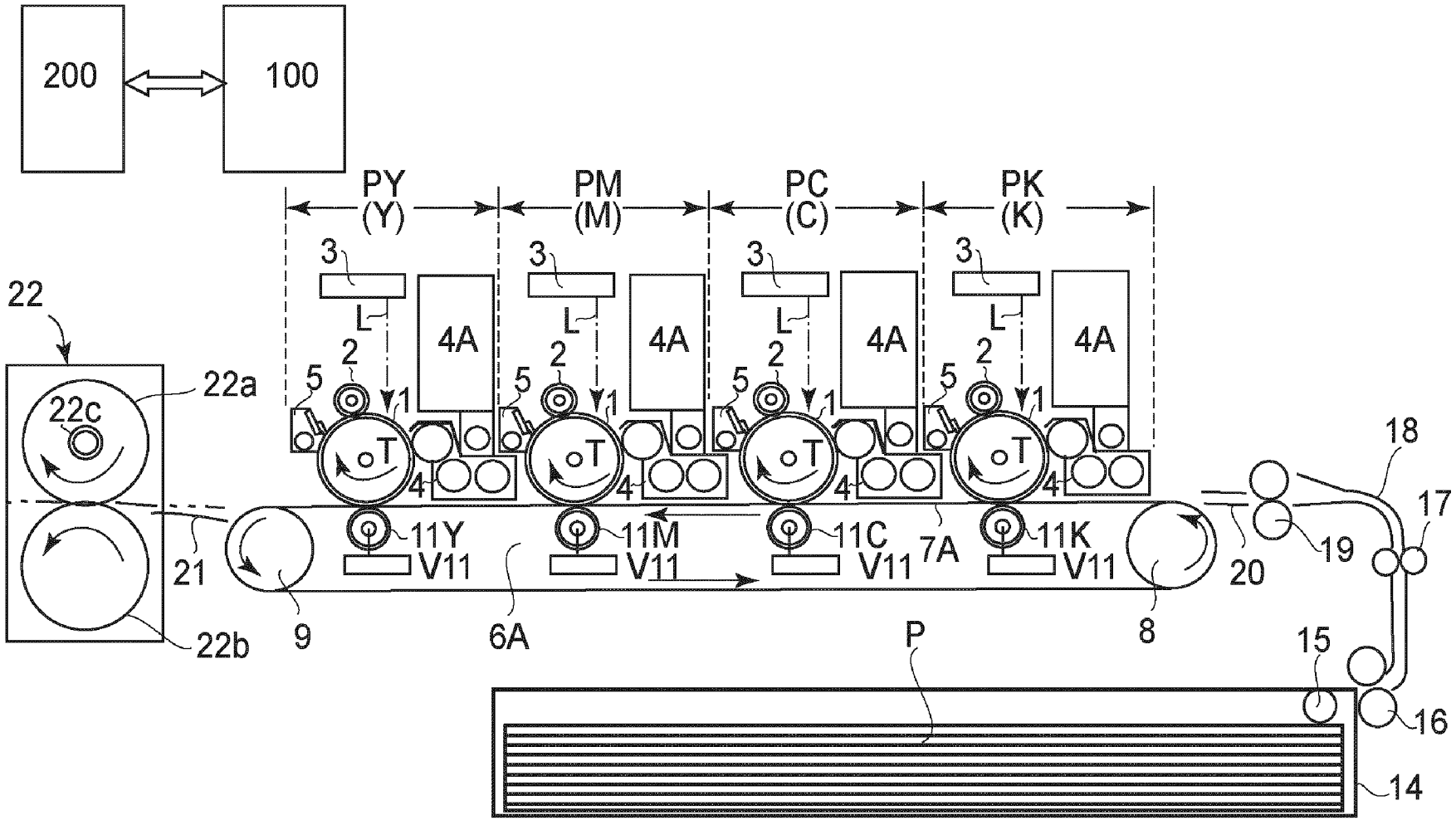
FIG. 10 is a schematic structural view of a major portion of an image forming apparatus in Embodiment 5.
Figure 11:
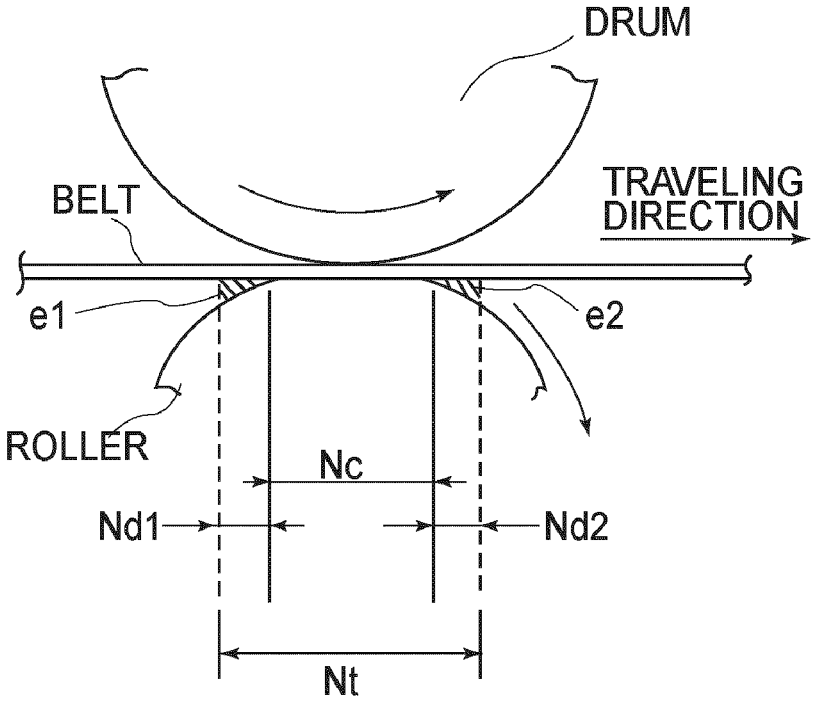
FIG. 11 is a schematic view for illustrating a contact nip and electric discharge nips of a transfer roller.
Figure 12:
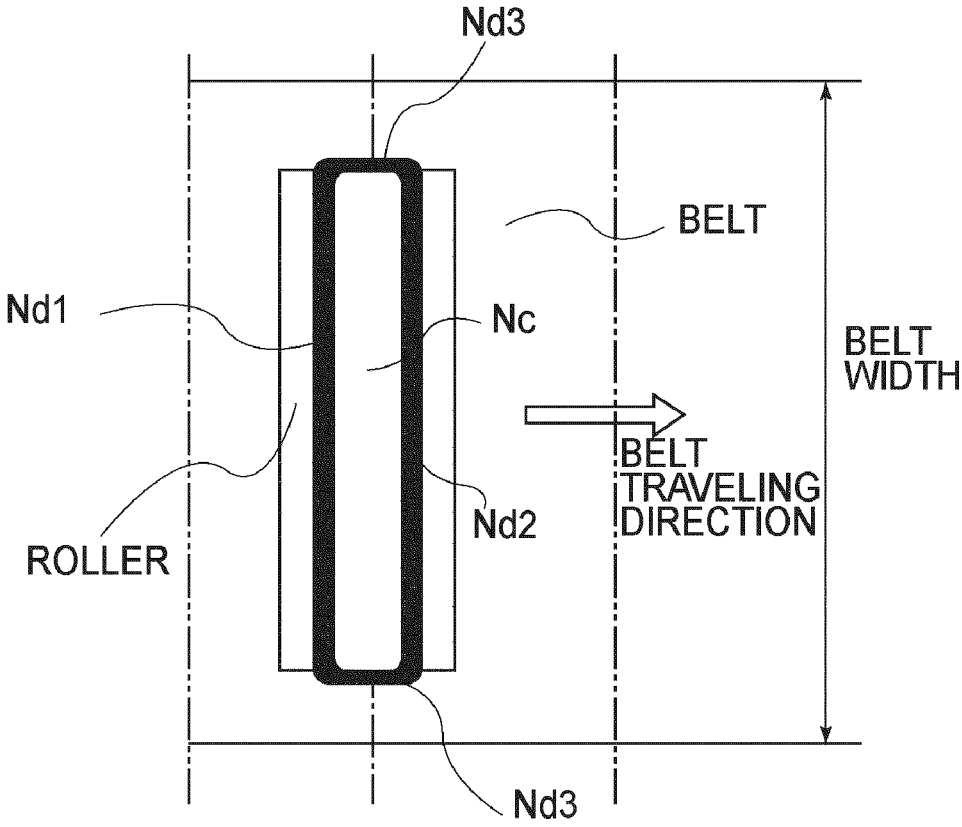
FIG. 12 is a schematic view for illustrating the contact nip and the electric discharge nips of the transfer roller with respect to longitudinal direction of the transfer roller.

FIG. 10 is a schematic view of an image forming apparatus in this embodiment (Embodiment 5). This image forming apparatus has the same constitution as that (printer) in Embodiment 1 except that the intermediary transfer unit 6 is changed to a transfer belt unit 6A including an endless transfer belt member (recording material conveying belt member) 7A and first to fourth transfer rollers 11 (Y, M, C, K). The transfer belt member 7A has the same constitution as that of the intermediary transfer belt member 7. Further, the constitution of the first to fourth transfer rollers 11 (Y, M, C, K) is also similar to that of the first to fourth primary transfer rollers 11 (Y, M, C, K).

The transfer roller member 7A of the transfer belt unit 6A is stretched between a belt stretching roller 9 positioned at the first process unit PY side and a belt stretching roller 8 positioned at the fourth process unit PK side. A transfer nip T is formed by bringing an upper surface of the belt portion between the rollers 8 and 9 into contact with each of lower surfaces of the respective process units PY, PM, PC and PK. In the transfer nips T, the transfer rollers 11 (Y, M, C, K) as transfer charging members are disposed in contact with an inner surface of the belt member 7. The recording material P is conveyed from the registration roller pair 19 into the belt member 7A while being guided by the guide member 20. The recording material P is conveyed in the transfer nip T of the fourth process unit, in which the black toner image formed on the drum 1 of the fourth process unit PK is transferred onto the recording material P. The recording material P is successively conveyed in the nips T of the third, second and first process units PC, PM and PY while being adsorbed and held on the belt member 7A. In these nips T, the recording material P is successively subjected to transfer of the cyan toner image, the magenta toner image, and the yellow toner image formed on the drums 1 of the process unit PC, the process unit PM, and the process unit PY, respectively, in the superposition manner. As a result, an unfixed four color-based full-color toner image is formed on the recording material P conveyed by the belt member 7A. The recording material P is conveyed toward the fixing apparatus 22 by further rotation of the belt member 7A and is separated from the belt member 7A to be introduced in the fixing apparatus 22 while being guided by the guide member 21.

Also in such an image forming apparatus in this embodiment, with respect to the first to fourth transfer rollers 11 (Y, M, C, K), corresponding positions on the belt member 7A for the right ends CR and left ends CL of the transfer rollers with respect to the belt width direction are different from each other.

In this embodiment, with respect to a direction perpendicular to the movement direction of the belt member 7A, the positions of the end portions of the belt member contact portions of the transfer rollers 11 (Y, M, C, K) are different from each other so that areas of the belt member 7A subjected to electric discharge from corresponding end portions of the transfer rollers do not overlap with each other. As a result, it is possible to stably output a good image for a long term.

The present invention is not limited to the above-described image forming apparatuses each including the four image carrying members and the four transfer rollers but is also applicable to at least an image forming apparatus in which first and second image carrying members and first and second transfer members forming nips between the image carrying members and the transfer members are provided and a voltage is applied to the first and second transfer members to transfer toner images from the first and second image carrying members onto the belt member or the recording material carried on the belt member.

Further, the image forming process mechanism of the image forming station is not limited to the electrophotographic process mechanism but may also be an electrostatic recording process mechanism.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 341029/2006 filed Dec. 19, 2006, which is hereby incorporated by reference.

What is claimed is:

1. An image forming apparatus comprising:

a movable belt member;

a rotatable first image bearing member for bearing a toner image;

a first transfer member for electrostatically transferring the toner image from said first image bearing member onto said belt member in contact with said belt member;

a rotatable second image bearing member for bearing a toner image; and a second transfer member for electrostatically transferring the toner image from said second image bearing member onto said belt member in contact with said belt member, wherein said first transfer member and said second transfer member are disposed so that a position of a first end portion of a first contact portion between said first transfer member and said belt member on at least one side of the first contact portion with respect to a rotational axis direction of said first image bearing member and a position of a second end portion of a second contact portion between said second transfer member and said belt member on the same side as said at least one side of the first contact portion are substantially different from each other with respect to the rotational axis direction.

2. An apparatus according to claim 1, wherein when the toner image is transferred onto said belt member or the recording material carried on said belt member, a maximum of a voltage applied to said first transfer members and a maximum of a voltage applied to said second transfer members are 6 kV as an absolute value and a gap between the first and second end portions with respect to said rotational axis direction is 1.5 mm or more.

3. An apparatus according to claim 1, wherein each of said first and second transfer members comprises a metal shaft and an electroconductive elastic layer formed around the metal shaft in a roller shape, and wherein the elastic layer of said first transfer member on said at least one side of the first contact portion and the elastic layer of said second transfer member on the same side as said at least one side of the first contact portion are the first end portion and the second end portion, respectively.

4. An apparatus according to claim 3, wherein with respect to the rotational axis direction, said electroconductive elastic layers of said first and second transfer members have a substantially equal length.

5. An apparatus according to claim 3, wherein with respect to the rotational axis direction, said electroconductive elastic layers of said first and second transfer members have different lengths.

6. An apparatus according to claim 1, further comprising a rotatable third image bearing member, disposed downstream of said second image bearing member with respect to a movement direction of said belt member, for bearing a toner image; and a third transfer member for electrostatically transferring the toner image from said third image bearing member onto said belt member in contact with said belt member, wherein the position of the first end portion and a position of a third end portion of a third contact portion between said third transfer member and said belt member on the same side as said at least one side of the first contact portion are substantially equal to each other with respect to the rotational axis direction.

7. An apparatus according to claim 1, further comprising a rotatable third image bearing member, disposed downstream of said second image bearing member with respect to a movement direction of said belt member, for bearing a toner image; and a third transfer member for electrostatically transferring the toner image from said third image bearing member onto said belt member in contact with said belt member, wherein the position of the first end portion and a position of a third end portion of a third contact portion between said third transfer member and said belt member on the same side as said at least one side of the first contact portion are spaced with an interval with respect to the rotational axis direction.

8. An apparatus according to claim 1, wherein positions of end portions on both sides of the first contact portion and positions of end portions on both sides of the second contact portion are substantially different from each other with respect to the rotational axis direction.

9. An image forming apparatus comprising:

a movable belt member;

a rotatable first image bearing member for bearing a toner image;

a first transfer member for electrostatically transferring the toner image from said first image bearing member onto said belt member in contact with said belt member;

a rotatable second image bearing member for bearing a toner image; and a second transfer member for electrostatically transferring the toner image from said second image bearing member onto said belt member in contact with said belt member, wherein said first transfer member and said second transfer member are disposed so that a first distance from a first end portion of a first contact portion between said first transfer member and said belt member on at least one side of the first contact portion with respect to a rotational axis direction of said first image bearing member to an end portion of said belt member on the same side as said at least one side of the first contact portion and a second distance from a second end portion of a second contact portion between said second transfer member and said belt member on the same side as said at least one side of the first contact portion to an associated end portion of said belt member on the same side as said at least one side of the first contact portion are substantially different from each other with respect to the rotational axis direction.

10. An apparatus according to claim 9, wherein when the toner image is transferred onto said belt member or the recording material carried on said belt member, a maximum of a voltage applied to said first transfer members and a maximum of a voltage applied to said second transfer members are 6 kV as an absolute value and a gap between the first and second end portions with respect to said rotational axis direction is 1.5 mm or more.

11. An apparatus according to claim 9, wherein each of said first and second transfer members comprises a metal shaft and an electroconductive elastic layer formed around the metal shaft in a roller shape, and wherein the elastic layer of said first transfer member on said at least one side of the first contact portion and the elastic layer of said second transfer member on the same side as said at least one side of the first contact portion are the first end portion and the second end portion, respectively.

12. An apparatus according to claim 11, wherein with respect to the rotational axis direction, said electroconductive elastic layers of said first and second transfer members have a substantially equal length.

13. An apparatus according to claim 11, wherein with respect to the rotational axis direction, said electroconductive elastic layers of said first and second transfer members have different lengths.

14. An apparatus according to claim 9, further comprising a rotatable third image bearing member, disposed downstream of said second image bearing member with respect to a movement direction of said belt member, for bearing a toner image; and a third transfer member for electrostatically transferring the toner image from said third image bearing member onto said belt member in contact with said belt member, wherein the first distance and a third distance from a third end portion of a third contact portion between said third transfer member and said belt member on the same side as said at least one side of the first contact portion to an associated end portion of said belt member on the same side as said at least one side of the first contact portion are substantially different from each other with respect to the rotational axis direction.

15. An apparatus according to claim 9, further comprising a rotatable third image bearing member, disposed downstream of said second image bearing member with respect to a movement direction of said belt member, for bearing a toner image; and a third transfer member for electrostatically transferring the toner image from said third image bearing member onto said belt member in contact with said belt member, wherein the first distance and a third distance from a third end portion of a third contact portion between said third transfer member and said belt member on the same side as said at least one side of the first contact portion to an associated end portion of said belt member on the same side as said at least one side of the first contact portion are substantially equal to each other with respect to the rotational axis direction.

16. An image forming apparatus comprising:

a movable belt member;

a rotatable first image bearing member for bearing a toner image;

a first transfer member for transferring the toner image from said first image bearing member onto said belt member in contact with said belt member by being supplied with a voltage;

a rotatable second image bearing member, disposed downstream of said first image bearing member with respect to a movement direction of said belt member, for bearing a toner image; and a second transfer member for transferring the toner image from said second image bearing member onto said belt member in contact with said belt member by being supplied with a voltage, wherein said first transfer member and said second transfer member are disposed so that a first area, located outside a first end portion of said first transfer member with respect to a rotational axis direction of said first image bearing member, in which electric discharge occurs on said belt member does not overlap with a second area, located outside a second end portion of said second transfer member with respect to the rotational axis direction, in which electric discharge occurs on said belt member when said belt member is moved.

17. An apparatus according to claim 16, wherein when the toner image is transferred onto said belt member or the recording material carried on said belt member, a maximum of a voltage applied to said first transfer members and a maximum of a voltage applied to said second transfer members are 6 kV as an absolute value and a gap between the first and second end portions with respect to said rotational axis direction is 1.5 mm or more.

18. An apparatus according to claim 16, wherein each of said first and second transfer members comprises a metal shaft and an electroconductive elastic layer formed around the metal shaft in a roller shape, and wherein the first end portion is an end portion of the elastic layer of said first transfer member and the second end portion is an end portion of the elastic layer of said second transfer member.

19. An apparatus according to claim 18, wherein with respect to the rotational axis direction, said electroconductive elastic layers of said first and second transfer members have a substantially equal length.

20. An apparatus according to claim 18, wherein with respect to the rotational axis direction, said electroconductive elastic layers of said first and second transfer members have different lengths.

21. An apparatus according to claim 16, further comprising a rotatable third image bearing member, disposed downstream of said second image bearing member with respect to the movement direction of said belt member, for bearing a toner image; and a third transfer member for electrostatically transferring the toner image from said third image bearing member onto said belt member in contact with said belt member;

wherein said first transfer member and said third transfer member are disposed so that a first area, located outside a first end portion of said first transfer member with respect to a rotational axis direction of said first image bearing member, in which electric discharge occurs on said belt member does not overlap with a third area, located outside a third end portion of said third transfer member with respect to the rotational axis direction, in which electric discharge occurs on said belt member when said belt member is moved.

22. An apparatus according to claim 16, further comprising a rotatable third image bearing member, disposed downstream of said second image bearing member with respect to the movement direction of said belt member, for bearing a toner image; and a third transfer member for electrostatically transferring the toner image from said third image bearing member onto said belt member in contact with said belt member, wherein said first transfer member and said third transfer member are disposed so that a first area, located outside a first end portion of said first transfer member with respect to a rotational axis direction of said first image bearing member, in which electric discharge occurs on said belt member overlaps with a third area, located outside a third end portion of said third transfer member with respect to the rotational axis direction, in which electric discharge occurs on said belt member, when said belt member is moved.

* * * * *